United States Patent [19]

Gibby

[11] 4,113,155

[45] Sep. 12, 1978

[54] NEEDLE

[76] Inventor: Mabel K. Gibby, 4501 Granda Blvd., Coral Gables, Fla. 33146

[21] Appl. No.: 818,055

[22] Filed: Jul. 22, 1977

[51] Int. Cl.[2] ..... D05B 55/00

[52] U.S. Cl. ..... 223/102

[58] Field of Search ..... 223/102, 103, 104; 57/23; 128/340, 339; 30/366

[56] References Cited

U.S. PATENT DOCUMENTS

| | | | |
|---|---|---|---|
| 354,018 | 12/1886 | Krieg | 223/102 |
| 877,476 | 1/1908 | Bach | 223/102 |
| 1,134,001 | 3/1915 | Olney | 223/102 |
| 2,740,568 | 4/1956 | Ostergaard | 223/102 |
| 3,031,116 | 4/1962 | Hunter et al. | 223/102 |

FOREIGN PATENT DOCUMENTS

| | | | |
|---|---|---|---|
| 446,935 | 3/1948 | Canada | 223/102 |
| 9,008 of | 1890 | United Kingdom | 223/102 |

*Primary Examiner*—George H. Krizmanich

[57] ABSTRACT

An improved needle having a pointed end and a pusher end with an eye adjacent the pusher end and wherein the pusher end zone is provided with a rounded nose portion to distribute pressure in sewing over a larger surface of a user's finger and wherein the nose portion is of no greater diameter than the maximum cross sectional area of the needle and wherein the nose portion may define a recess and include a plug captivated in the recess.

4 Claims, 3 Drawing Figures

NEEDLE

FIELD OF THE INVENTION

This invention relates to an improved needle.

BACKGROUND OF THE INVENTION

As is perhaps well known, in sewing, thimbles are often used to push a needle through cloth because of the relative sharpness of the pushing end of the needle. In the past, numerous prior art patents have provided members with enlarged end zones to spread the load, such as small tacks, etc. Representative prior art is that of U.S. Pat. No. 2,611,168 which is for a plastic and metal headed pin; U.S. Pat. No. 3,728,763 which includes an enlarged end of a pin but which, deliberately cannot be pulled through cloth as in sewing; U.S. Pat. No. 3,154,229 which is of a hooked needle with an enlarged head 2 which is not for sewing but is, in reality, a hook. U.S. Pat. Nos. 3,205,757 and 3,386,328 are for thumbtacks or nails which typically have enlarged heads.

OBJECTS OF THIS INVENTION

It is an object of this invention to provide a needle which can be used without a thimble and which includes a tapered shank tapering to a pointed end from a pusher end with a thread passageway and which has an end zone which is provided with a smoothly rounded end, and which may have an axially facing recess and in which there is captivated a plug. The plug may be of a yieldable or rubbery material or a plastic, such as nylon or other suitable compounds. The mouth of the recess may be crimped or folded over into captivating engagement of the plug.

It is an object of this invention to provide an improved needle, (i.e., a small slender metal instrument with an eye for thread at one end for sewing and which may be utilized in so doing without the need of a thimble,) wherein a plug is captivatingly engaged in the pusher end of the needle without enlargement of the diameter of the pusher end of the needle. The device is to be distinguished from a pin which is a small pointed piece of wire with a head and not used for sewing. It is also to be distinguished from a tack which is a small, short sharp pointed nail. The present device does not have a head in the sense that a neck is provided or an enlarged outer terminal end is provided.

In accordance with these and other objects which will become apparent hereinafter, the instant invention will now be described with reference to the accompanying drawings in which:

DESCRIPTION OF PREFERRED EMBODIMENT

Figure 1:
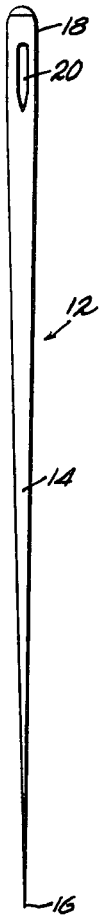
FIG. 1 is a side elevation view.
Figure 2:
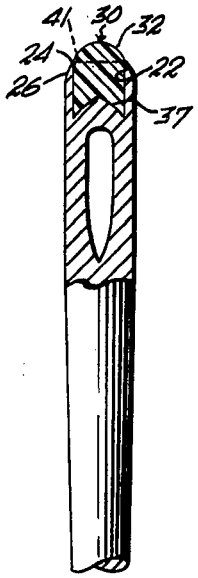
FIG. 2 is a partial view in cross section of the pusher end of the needle.

Referring to the drawings wherein like reference characters designate like or corresponding parts throughout the several views, the numeral 12 generally designates a needle having a shank portion 14 which tapers to a pointed end 16 and a pusher end 18 having a through opening 20 to accommodate passage of a thread. The end 18 is best considered as a zone outwardly beyond the thread passage 20 and, as seen in FIG. 2, it includes an axially extending recess 22 terminating at a mouth 24 which merges and blends in a fair curve as at 26 with the surface of the end zone so that the entire length of the needle is a smooth straight line as opposed to a bulbous enlarged end zone. Within the recess a plug 30 is captivated. In the embodiment shown, the plug is generally semi-spherical in an axially protruding portion 32 which includes a body which is in the recess, and which body may be of suitable material, such as plastic or other rubbery material. Preferably the floor of the recess 37 includes a central raised portion defining what can aptly be described as an outer deeper annular portion of the recess for gripping the plug once compressed into it. In the preferred embodiment the mouth may be crimped slightly defining a slight angular depression or ring 41 represented by the dotted line for gripping the rim.

In use, it is seen that the device is a needle with a "soft" pushing end and which does not include an enlarged bulbous zone so that it can pass through cloth readily in sewing.

Figure 3:
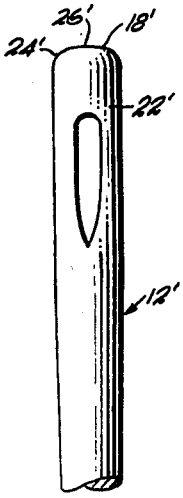
FIG. 3 is a partial view of the pusher end of an alternative embodiment.

In the embodiment shown in FIG. 3 the sewing needle 12' has an end zone 22' between the eye and the distal pusher end 18' which is not of reduced cross sectional area and is not distally tapered in configuration but which is of full cross sectional area equal to that of the maximum cross sectional area of the needle substantially completely to the end and which is no greater in area than the maximum cross sectional area so as to prevent an obstruction in passing through cloth in sewing, with the top end or brink edge being rounded and smooth as at 24' to present a pusher surface 26' of substantial area as a pad to be pushed upon by the end of the finger of a user.

What is claimed is:

1. An improved sewing needle for drawing thread through fabric comprising a needle length having a first end and a second end and a smooth outer surface, said needle being provided with a single eye adjacent the second end, said needle being generally circular in cross section between each of the ends and the eye, and an end zone being defined between said eye and said second end, said second end defining a rounded distal nose portion pusher means of a diameter no greater than but substantially equal to the maximum cross sectional area of the needle between the ends and the eye and defining a pusher zone for pushing the needle through cloth in sewing, and wherein the second end is rounded and smooth presenting a pad pusher surface.

2. An improved sewing needle for drawing thread through fabric comprising a needle length having a first end and a second end and a smooth outer surface, said needle being provided with a single eye adjacent the second end, and an end zone being defined between said eye and said second end, an axially facing recess in said second end, and a body of material in said recess, said body having a rounded nose portion projecting from said second end and means to captivate the body in said recess, the diameter of said needle at said second end zone being no greater than that of the maximum cross sectional area of the needle at said eye, and the nose portion defining a pusher zone for pushing the needle through cloth in sewing, said surface between said ends and said eye being smooth and uninterrupted and said needle being generally circular in cross section between the ends and the eye, and said body being of rubbery material.

3. The device as set forth in claim 2 wherein said rubbery material is of plastic.

4. An improved sewing needle for drawing thread through fabric comprising a needle length having a first end and a second end and a smooth outer surface, said needle being provided with a single eye adjacent the second end, said needle being generally circular in cross section between each of the ends and the eye, and an end zone being defined between said eye and said second end, said second end defining a rounded distal nose portion pusher means of a diameter no greater than but substantially equal to the maximum cross sectional area of the needle between the first end and the eye and between the second end and the eye and defining a pusher zone for pushing the needle through cloth in sewing which is smooth presenting a pushing force distribution surface.

* * * * *